United States Patent [19]

Padgug

[11] 3,940,632

[45] Feb. 24, 1976

[54] NONPREDICTABLE ACTUATOR FOR SWITCHES OR THE LIKE

[75] Inventor: Robert Allen Padgug, Williamsville, N.Y.

[73] Assignee: Calspan Corporation, Buffalo, N.Y.

[22] Filed: Mar. 4, 1974

[21] Appl. No.: 447,607

[52] U.S. Cl. ..... 307/112; 235/152; 315/200 A; 315/360; 331/78; 307/141

[51] Int. Cl.[2] ..... H01H 7/00

[58] Field of Search ..... 307/112, 141 R, 141.4; 328/158, 48, 61, 153; 315/360, 362; 331/78; 235/152

[56] References Cited

UNITED STATES PATENTS

| | | | |
|---|---|---|---|
| 3,439,281 | 4/1969 | McGuire et al. | 331/78 |
| 3,506,876 | 4/1970 | Antonich | 331/78 |
| 3,539,927 | 11/1970 | Havel | 328/61 |
| 3,746,847 | 7/1973 | Maritsas | 331/78 |

*Primary Examiner*—David Smith, Jr.
*Attorney, Agent, or Firm*—Allen J. Jaffe

[57] ABSTRACT

A nonpredictable, nondeterministic actuator for switches or the like having two unsynchronized pulse generators delivering pulses to an AND gate which passes an actuating signal only when the pulses from the generators are coincidental. One generator produces a pulse train at a frequency much higher than the other generator which produces very short pulses and has a maximum timing uncertainty or jitter which is greater than the period of the first mentioned generator.

12 Claims, 2 Drawing Figures

NONPREDICTABLE ACTUATOR FOR SWITCHES OR THE LIKE

BACKGROUND OF THE INVENTION

The present invention relates to a nonpredictable actuator for switches or the like and finds particular application in turning on and off home lighting systems at times which cannot be predicted, for the protection of the premises against burglary or the like.

Many different timers or clocks are known which have as an objective the opening and closing of circuits which control the actuation of home lighting to give an indication that an unoccupied home has someone present turning lights on and off. These devices have the serious disadvantage that they are predictable. In other words, in the use of these devices a predetermined time interval is set and the lights are periodically and repeatably actuated according to this preset time interval. An experienced burglar need only observe the regularity of light actuation to conclude that the premises are unoccupied.

SUMMARY OF THE INVENTION

The foregoing disadvantage of the prior art are overcome according to the present invention which provides a randomly actuable switch apparatus controlling an electric circuit, such as house lamps or lighting, in such a manner that the switching times cannot be predicted but which do obey a preset probability density function.

It is generally accepted that a house or an apartment left without lights for a prolonged period of time appears unoccupied to a potential thief. Many people leave a light on when they are out to give the impression that their home is occupied. However, a light that is always on is as good an indication of an unoccupied home as a light that is always off. Use of a time switch or a light sensitive switch is better but, in both cases, the operation of the switches is predictable. Such predictability is a clue to a thief that the home is unoccupied.

The randomly actuable or nondeterministic switch of the present invention is not predictable and a light operated thereby will give the appearance that the home is occupied.

The electronics of such a nondeterministic switch are inexpensive allowing more than one to be utilized in the average home.

Basically, the switch actuator according to the present invention comprises two or more unsynchronized pulse generators one of which produces a pulse train at a first frequency, the other of which produces very short pulses at a second frequency which is much lower than the first frequency and means responsive to said pulses for generating an actuating signal only when the pulses produced by said generators are coincidental.

The pulse generators are so chosen that the uncertainty or jitter (variance from complete accuracy along the time axis from pulse to pulse) in the period of the pulses generated at the second frequency is greater than the period of the first frequency pulse generator such that the pulses at the second frequency will occur randomly at any time during a cycle of the first frequency generator. Thus, the pulses from the two generators will be coincidental in time with a probability equal to $\tau$, which is defined as the ratio of the pulse width of the first pulse to the period thereof.

According to another aspect of the present invention means are provided to actuate the lights to one condition in response to a predetermined number of random coincidental signals and to another condition after a predetermined equal or different number of random coincidental signals. This means may conveniently take the form of a counter and has the further significant advantage, as will become apparent hereinbelow, of reducing the variance of the mean switching times from say, many hours or days to minutes.

BRIEF DESCRIPTION OF THE DRAWINGS

For a fuller understanding of the present invention reference should now be had to the following detailed description of the same taken in conjunction with the accompanying drawings, wherein.

DESCRIPTION OF THE PREFERRED EMBODIMENTS

Figure 1:
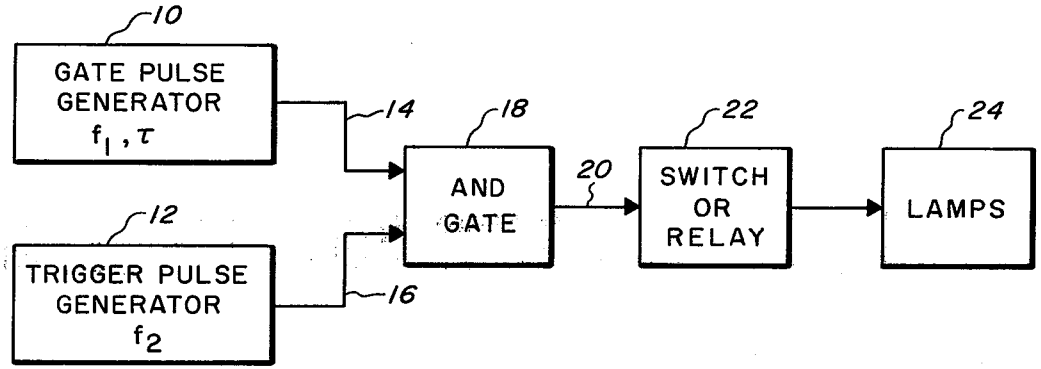
FIG. 1 is a schematic block diagram of one embodiment of the present invention.

Referring now to the drawings and, more particularly to FIG. 1, a first pulse generator, termed a gate pulse generator, is depicted at 10 and a second pulse generator, termed a trigger pulse generator, is depicted at 12. The pulse generators can take any convenient conventional form such, as for example, Unijunction Transistor Oscillators, the RC circuits of which are adjustable to vary or set the frequencies $f_1$ and $f_2$ of each. Alternatively, other well known pulse generators can be utilized as is obvious to those skilled in the art.

The gate pulse generator 10 produces as an output in line 14 a pulse train at frequency $f_1$ and duty cycle $\tau$ as previously defined. The trigger pulse generator 12, on the other hand, produces as an output in line 16 very short pulses at frequency $f_2$ such that $f_1$ is much higher than $f_2$. The period $1/f_1$ of generator 10 is chosen to be shorter than the jitter or uncertainty on the time axis of the period of the generator 12. In this manner the pulses in line 16 can occur at any point during a cycle of the gate generator 10, hence the two pulses in lines 14 and 16 will be coincidental in time with a probability equal to $\tau$. As a consequence, every $1/f_2$ seconds an experiment will be performed that has a probability of success, that the two pulses in line 14 and 16 are coincident, equal to $\tau$.

The output pulses in lines 14 and 16 are supplied as inputs to an AND gate 18 which, as is well known, will deliver an output signal in line 20 only when the pulses in lines 14 and 16 are coincidental. Thus, the AND gate 20 will pass a pulse to switch or relay 22 for the actuation of lamps or the like 24 only when the pulses in lines 14 and 16 are coincidental in time and the waiting between output pulses from the AND gate 18 will follow a geometric distribution with probability $\tau$.

It is desirable to keep $1/f_2$ reasonably small since the time between output actuating pulses in line 20 will always be a multiple of this time. If $1/f_2$ is too long, it is conceivable that an observer of the home or apartment could determine that such a switching device was in use and conclude that the premises was unoccupied. However with $1/f_2$ reasonably small, say about one second, and the mean switching time in the order of thirty minutes, the resulting distribution of waiting times would be too broad for the security application of the present invention. In other words, there would be a high probability, because of the nature of the geometric distribution, that no switching would occur for hours or even days. While this may be suitable for some security applications and other applications such as games; statistical, educational and scientific, it is not suitable for the vast majority of home security problems.

Figure 2:
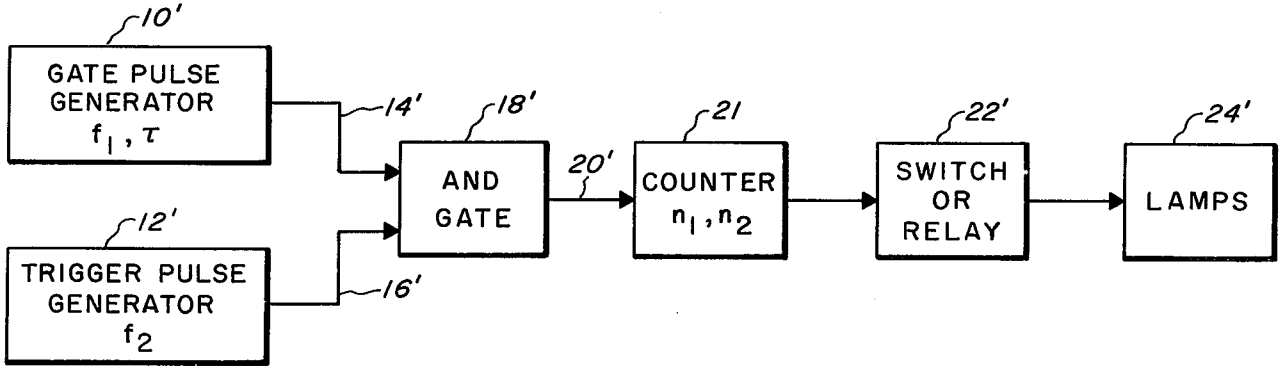
FIG. 2 is a schematic block diagram of a second embodiment of the present invention.

The problem of too broad a geometric distribution can be alleviated by the embodiment of FIG. 2 wherein like numerals with the addition of primes refer to similar parts of FIG. 1 having the same numerals.

In the embodiment of FIG. 2 counting means or its equivalent 21 is inserted between the AND gate 18' and the switching or relay means 22'. Any conventional counter may be utilized which passes or generates a first actuating signal (say, a turn-on signal) in response to $n_1$ pulses from line 20' and which delivers a second actuating signal (say, a turn-off signal) in response to $n_2$ pulses from line 20'. Of course, $n_1$ can equal $n_2$, as is well known. The addition of the counter 21 has two distinct advantages. The first, with $n_1$ different from $n_2$ the ratio of the on time to the off time (on the average) can be controlled by varying such differences between $n_1$ and $n_2$. The second advantage, and probably the most important, is that the geometric distribution of the waiting time between coincidental pulses from the pulse generators of FIG. 1 can be converted to a Pascal-type distribution with a much lower variance of the distribution of waiting times between coincidental pulses. Without the counter 21 an increase of $\tau$, the duty cycle of gate generator 10', increases the probability of coincidental pulses from each generator; however, the mean waiting time between such coincidental pulses would decrease to the point of rendering the device impractable or unsuitable for many applications. Unfortunately no value of $\tau$ would produce the result desired, in many applications, of having the preferred mean switching time within a reasonable variance. For example, a mean switching time of 30 minutes may be desirable coupled with a low probability of waiting longer than, say, 90 minutes or shorter than, say, 10 minutes. The counter 21 solves this problem by changing the distribution of waiting times to a Pascal-type distribution which is much narrower than the geometric distribution.

Counter 21 actually averages the waiting time between coincidental pulses from the pulse generators thereby collapsing the variance of the distribution of waiting times, although the mean waiting time between counter output signals is increased. However, $\tau$ can be now increased to reduce such waiting time. For example, if without the counter the mean waiting time between coincidental pulses was 30 minutes, then with the counter and without changing $\tau$ the mean waiting time could be 300 minutes, assuming $n_1$ and $n_2$ equal to 10. Since this mean waiting time is longer than desired, $\tau$ can be increased to bring the mean waiting time back to, say, 30 minutes and the narrow Pascal-type distribution would still be retained.

The counter 21 can consist of any well known type of components such as, by way of example and not limitation; if $n_1 = 5$ and $n_2 = 11$ was desired, a 4-bit binary counter such as a TTL IC No. 7493 can be used. The outputs of this counter ABCD can then be applied to logic circuits designed to give an output for the combinations 0101 and 0000, as is well known to those skilled in this field.

Although preferred embodiments of the present invention have been disclosed, changes will obviously occur to those skilled in the art without departing from the spirit thereof. For example, although electronic circuits have been disclosed, it is possible to utilize equivalent or analog mechanical or fluid circuits. It is therefore intended that the present invention be limited only by the scope of the appended claims.

I claim:

1. A nonpredictable actuator for switches or the like, comprising;

a. first pulse generating means for producing a first output consisting of a train of pulses at a first frequency, b. second pulse generating means for producing a second output of short pulses at a second frequency which is much lower than said first frequency, and c. means responsive to said first and second outputs for generating an actuating signal for lamp circuits or the like only when said first and second output of pulses are coincidental.

2. The apparatus according to claim 1, wherein said first and second pulse generating means are unsynchronized.

3. The apparatus according to claim 2, wherein the period of said first pulse generating means is smaller than the jitter on the time axis of the period of said second pulse generating means.

4. The apparatus according to claim 3, further comprising;

d. counting means responsive to the output of said means for generating an actuating signal for developing a first output signal after a predetermined number of actuating signals and a second output signal after a second predetermined number of actuating signals.

5. The apparatus according to claim 4, wherein said first and second predetermined numbers are equal.

6. The apparatus according to claim 4, further comprising;

e. switching means responsive to the first and second outputs of said counting means for changing the condition of a controlled circuit.

7. The apparatus according to claim 6, wherein said controlled circuit comprises a lighting circuit.

8. The apparatus according to claim 1, wherein the period of said first pulse generating means is smaller than the jitter on the time axis of the period of said second pulse generating means.

9. The apparatus according to claim 8, further comprising;

d. counting means responsive to the output of said means for generating an actuating signal for developing a first output signal after a predetermined number of actuating signals and a second output signal after a second predetermined number of actuating signals.

10. The apparatus according to claim 9, further comprising;

e. switching means responsive to the first and second outputs of said counting means for changing the condition of a controlled circuit.

11. The apparatus according to claim 10, wherein said means responsive to said first and second outputs for generating an actuating signal comprises an AND gate.

12. The apparatus according to claim 1, wherein said means responsive to said first and second outputs for generating an actuating signal comprises an AND gate.

* * * * *